US007631756B2

(12) United States Patent
Picot et al.

(10) Patent No.: US 7,631,756 B2
(45) Date of Patent: Dec. 15, 2009

(54) CARRYING MEANS FOR AN ARTICLE HAVING AT LEAST ONE RECTILINEAR SURFACE, IN PARTICULAR A LAPTOP COMPUTER

(76) Inventors: Francois Picot, Route de Vernay, Combloux (FR) 74920; Gérald Truffier-Blanc, Rue du Sabot, La Terrasse (FR) 38660

( * ) Notice: Subject to any disclaimer, the term of this patent is extended or adjusted under 35 U.S.C. 154(b) by 489 days.

(21) Appl. No.: 11/490,429

(22) Filed: Jul. 20, 2006

(65) Prior Publication Data

US 2007/0029218 A1 Feb. 8, 2007

(30) Foreign Application Priority Data

Aug. 4, 2005 (FR) ..... 05 52432

(51) Int. Cl.
*B65D 85/00* (2006.01)

(52) U.S. Cl. ..... 206/320; 206/576; 206/583

(58) Field of Classification Search ..... 206/320, 206/521, 576, 583, 591, 592, 205
See application file for complete search history.

(56) References Cited

U.S. PATENT DOCUMENTS

| | | | | |
|---|---|---|---|---|
| 4,030,601 | A * | 6/1977 | Ackeret | 206/387.12 |
| 4,778,228 | A * | 10/1988 | Ackeret | 312/9.43 |
| 4,981,215 | A * | 1/1991 | Ilic | 206/521 |
| 5,363,960 | A * | 11/1994 | Ackeret | 206/387.12 |
| 5,529,174 | A * | 6/1996 | McQueeny | 206/749 |
| 5,622,262 | A * | 4/1997 | Sadow | 206/522 |
| 5,810,171 | A * | 9/1998 | Lee | 206/523 |
| 5,884,768 | A * | 3/1999 | Fox | 206/522 |
| 5,909,806 | A * | 6/1999 | Fischel et al. | 206/320 |
| 6,105,764 | A * | 8/2000 | Scicluna et al. | 206/320 |
| 7,264,116 | B2 * | 9/2007 | Prentza | 206/320 |
| 2002/0027052 | A1 | 3/2002 | Godshaw et al. | |

FOREIGN PATENT DOCUMENTS

| | | | |
|---|---|---|---|
| FR | 2 750 021 | A1 | 12/1997 |
| FR | 2 796 254 | A1 | 1/2001 |
| GB | 165 594 | A1 | 7/1921 |
| GB | 382 490 | A1 | 10/1932 |
| WO | 2004/045328 | A1 | 6/2004 |

* cited by examiner

*Primary Examiner*—Luan K Bui
*Assistant Examiner*—Chun Cheung
(74) *Attorney, Agent, or Firm*—Burr & Brown

(57) ABSTRACT

This carrying means for an article having at least one rectilinear surface comprises at least one compartment of measurements suitable to enable it to receive the article, and demarcated by a base and lateral surfaces. The base of the said compartment receives an intermediate support component that is suspended relative to the base and capable of operating as a shock absorber.

9 Claims, 5 Drawing Sheets

CARRYING MEANS FOR AN ARTICLE HAVING AT LEAST ONE RECTILINEAR SURFACE, IN PARTICULAR A LAPTOP COMPUTER

FIELD OF THE INVENTION

The invention relates to means, particularly a bag, briefcase, attaché case or similar item, for carrying an article having at least one rectilinear surface, and more particularly that is of more or less parallelepiped shape.

This type of article is intended to designate, but not be limited to, a laptop computer or any equivalent electronic device such as a PDA, graphics tablet, touch-screen, data entry terminal, etc. and generally speaking any article having one measurement much smaller than its other two measurements.

The carrying means to which the invention relates may be of any type and may consist of a bag, a back-pack, i.e. carried on the user's back by means of straps, or of any type of container usually held in the hand such as for example a briefcase, attaché case, etc.

BACKGROUND OF THE INVENTION

The relative fragility of laptop computers and similar systems has led the industry to design protective bags or shells that are usually rigid and/or fitted with shock absorbers designed to ensure the safety of the article in question, particularly while it is being transported. This type of cover is disclosed in patent FR-A-2,796,254.

While such protective covers or shells fulfil the role of ensuring the physical integrity of a laptop computer while it is being transported, they nevertheless have the drawback of being dedicated to that purpose, i.e. they can only be used to transport laptop computers.

Bags, back-packs, briefcases and other more general articles do not usually allow laptop computers to be carried safely. Moreover, even where they are provided with a special compartment designed to receive this type of article, the fact that they are made to standard measurements means that there is a certain degree of movement due to the weight of the laptop computer that is liable to move inside the volume so defined, reducing wearer comfort during carrying and moreover somewhat reducing the effective protective function of this type of article.

Furthermore, in this type of container there is a risk of the laptop computer coming into virtually direct contact with the ground if not actually striking it when the container is placed on the ground. This type of impact is capable of causing the total or partial destruction of the laptop, not to mention possible contact with moisture, which should be avoided at all costs for articles using electrical or electronic components.

Lastly, experience has shown that it is sometimes difficult to remove a laptop computer from a bag in which it has been placed, particularly due to the measurements of the bag.

SUMMARY OF THE INVENTION

The aim of the present invention is therefore to overcome these different drawbacks and to provide, within more general means for carrying articles, a solution suitable for the transport of articles with at least one rectilinear surface, particularly parallelepiped-shaped articles, particularly laptop computers, that simultaneously fulfils the function of protecting the article carried and that of comfort during carrying.

This carrying means for an article with at least one rectilinear surface comprises at least one compartment of measurements suitable to enable it to receive the article, and demarcated by a base and lateral surfaces.

According to the invention the base receives an intermediate support component that is suspended relative to the base and designed to receive the rectilinear surface of the article, the component being capable of acting as a shock absorber, as a means of ejecting the carried article from the carrying means, and as a corollary, of preventing impacts.

Put another way, the invention consists of equipping a bag and more generally any carrying means of standard design with a special compartment having a type of double base, the base of the compartment itself and a base suspended above the base of the compartment itself, receiving the article in question on one of its edges.

According to the invention the suspension of the intermediate support component is achieved by means of mechanical springs such as coil or leaf spring, etc., the spring constant of the spring or springs being suited to the weight of the article intended to be received by the compartment and the degree of shock-absorbing function required from the intermediate support component.

These mechanical springs are thus compressible and flexible and have a certain degree of resilience capable of acting as a shock-absorber for the article being carried.

Moreover, due to the compressible character of the assembly consisting of the intermediate support component and the springs that provide suspension, the apparent weight of the article to be carried is reduced for the user due to the shock-absorbing effect of the springs.

According to one advantageous characteristic of the invention, the base on which the mechanical springs are fitted is itself movable so that the assembly consisting of the intermediate support component, the mechanical springs and the support base or plate constitutes a single entity that is simply placed or positioned on the base of one of the compartments of the carrying means in question.

According to another advantageous characteristic of the invention, the two main measurements of the intermediate support component are extended by two lateral surfaces, the surfaces running in the direction of the opening that gives access to the compartment.

These lateral surfaces are moreover advantageously inserted in a lining or in pockets provided for this purpose that are created inside the lateral surfaces of the carrying means demarcating the compartment in question.

In this way the article to be carried is naturally guided inside the guide tunnel thus demarcated inside the compartment in question, which encourages it to be maintained inside the carrying means and, as a corollary, protects it.

According to an improved version of the invention, one or more of the four lateral surfaces that, together with the base, demarcate the dedicated compartment are also fitted with spring-type shock absorbers. Due to the standard measurements likely to be chosen for the compartment in question, these means can thus also fulfil the function of wedging the article to be carried.

Advantageously, the upper surface of the compartment, i.e. the surface through which the article to be carried is inserted, is fitted with an anti-ejection system such as for example a flap, designed to maintain the article inside the compartment while partially clamping it. Freeing this closure system causes partial ejection of the article, enabling the user to grasp it and remove it from the compartment.

This system may also be constructed as an integral part of the article to be carried.

BRIEF DESCRIPTION OF THE DRAWINGS

The way the invention can be implemented and the resulting advantages will be understood better from the following embodiment which is a non-limitative example and refers to the attached figures where:

FIG. 1 is a schematic perspective drawing of carrying means according to the invention, of which

FIG. 3 is a schematic illustration of the operating principle of the dedicated compartment of the carrying means of the invention in the closed position, of which

DETAILED DESCRIPTION OF THE INVENTION

Figure 1:
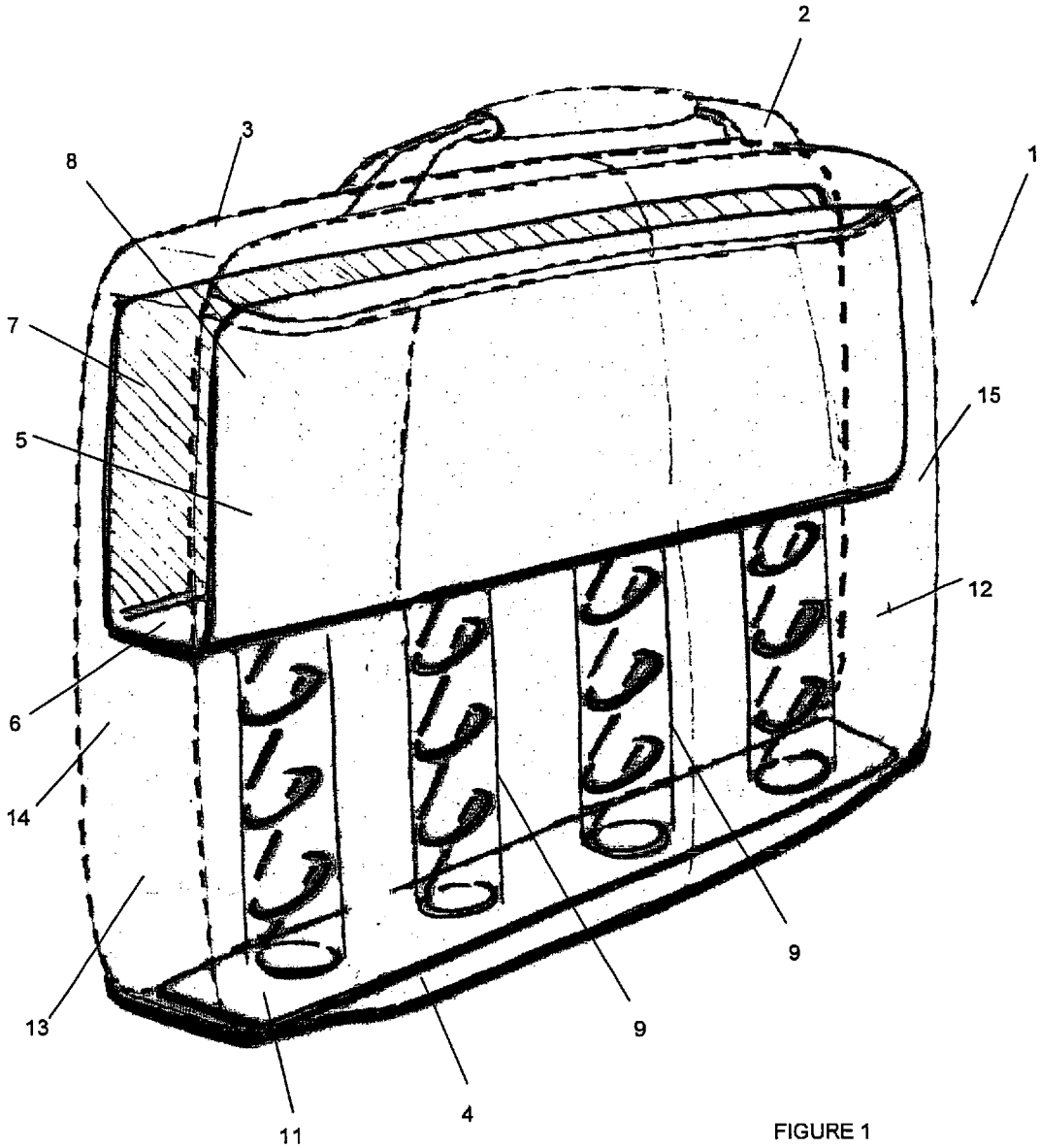

FIG. 1 shows an attaché case (1) that implements the present invention. The attaché case is provided with a handle (2) fitted to its upper surface (3).

In order to simplify the explanation the attaché case in is shown having a single compartment (10). It is, however, understood that the number of compartments is not a limitative characteristic of the present invention.

In this example the compartment (10), which is integrated in the carrying means, is demarcated by a base (4) that is more or less flat, main lateral surfaces (12) and (13), secondary lateral surfaces (14) and (15) and an aperture (16) giving access to the inside of the compartment, particularly to introduce a laptop computer (20).

The measurements of this compartment are appropriate for the article it is intended to receive (20), in this instance a laptop computer. "Appropriate measurements" are understood to be measurements that will enable the laptop computer to be inserted easily into the compartment. Advantageously, when a certain standardization of the measurements of laptop computers is envisaged, it will be possible to choose these measurements so that while being easy to insert, the laptop computer remains nonetheless correctly supported inside the compartment.

However, the compartment may receive one or more pads made of foam or equivalent material designed to be inserted along the main (12, 13) and/or secondary (14, 15) lateral surfaces better to grip the article to be carried (20) if the measurements of the article are much smaller than those of the compartment.

According to one essential characteristic of the invention, this dedicated compartment (10) is provided with an intermediate support component (5). In the example described in FIGS. 3 and 4 this intermediate support component (5) consists of a flat panel (6) that is advantageously rigid and that occupies a surface area roughly equivalent to that of a support panel (11) designed to be positioned with a little play on the base (4) of the compartment in order to allow the translational movement of the component (5) inside the compartment.

This panel (6) is designed to be able to make translational movements inside the compartment, guided particularly by lateral surfaces (12) and (13), or (14) and (15).

This support component (5) is fastened to the support panel (11) and also suspended in relation to it, as can be seen from FIGS. 1 to 4, particularly by means of coil springs (18) and (19). One of the ends of the springs is bonded, sewn or riveted to the lower surface of the panel (6) and the other end is bonded, sewn or riveted to the support panel (11). These springs are advantageously covered by a sheath (9) that limits any risk of their being extended other than in their preferred direction of compression.

The assembly consisting of the intermediate support component (5), the springs (18, 19) and the support panel (11) thus constitutes a single entity capable of resting via the support panel (11) on the base (4) of the compartment dedicated to this function.

Figure 3:
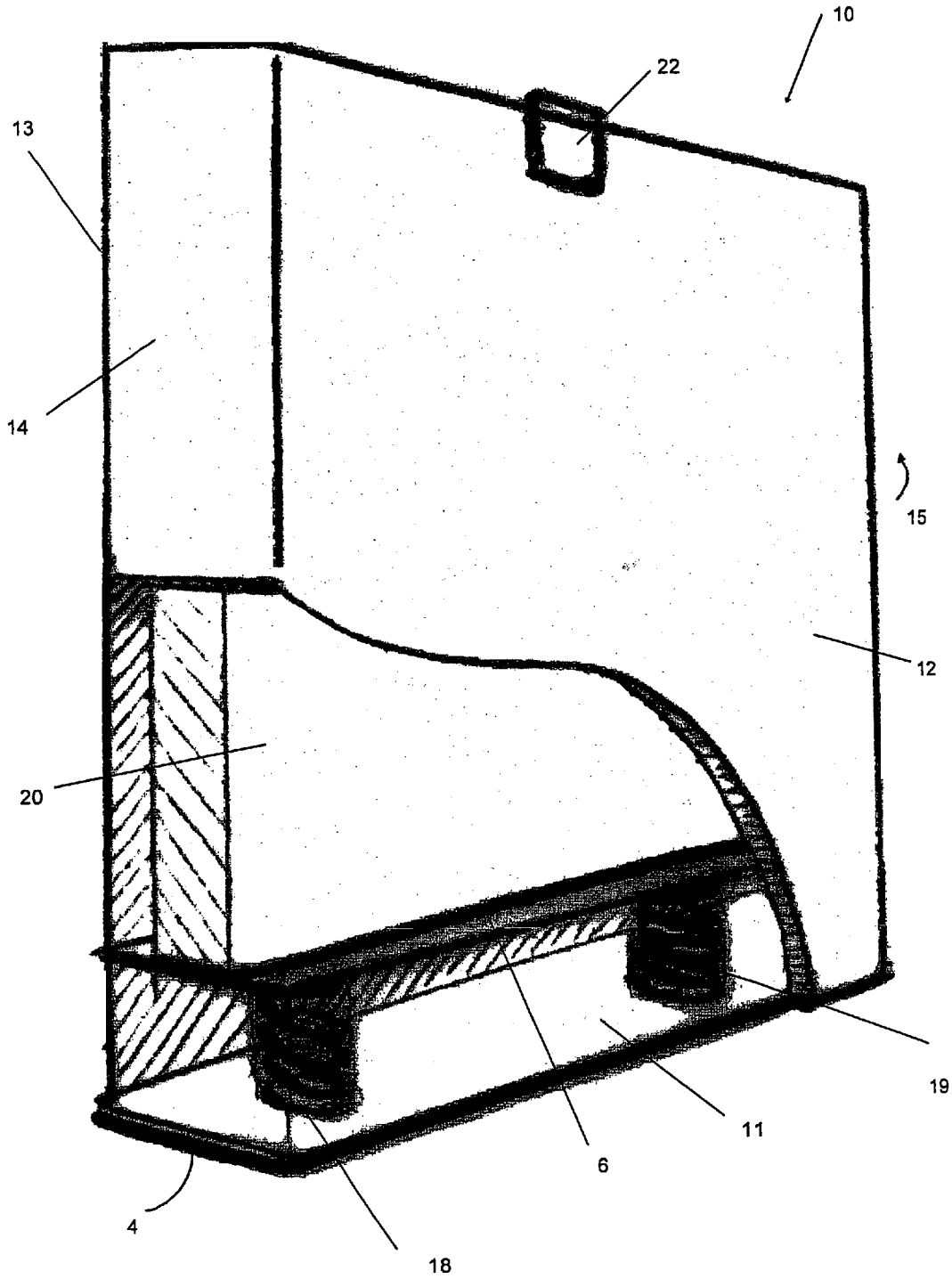
Figure 4:
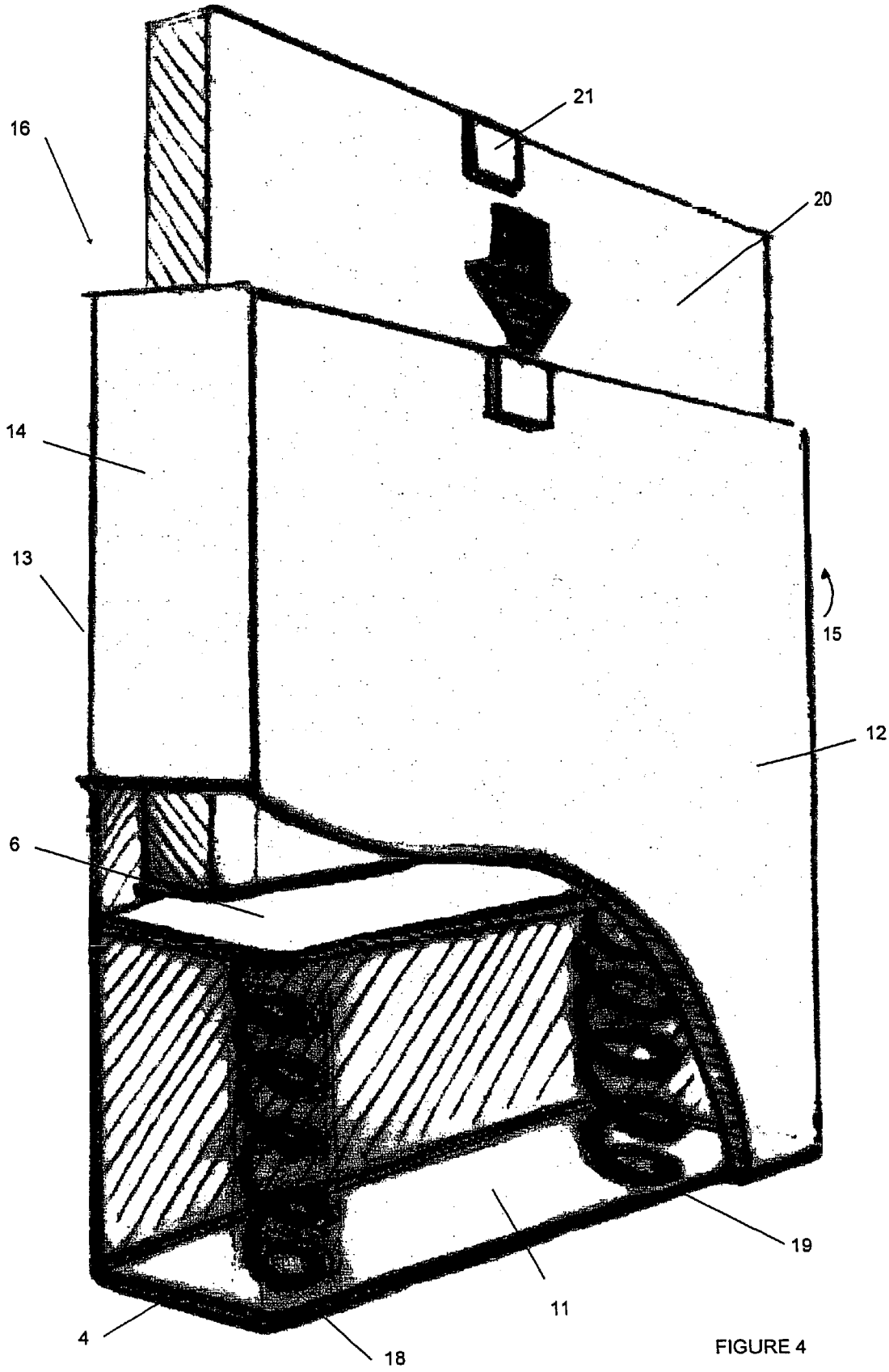
FIG. 4 is a similar view in the open position.

FIGS. 3 and 4 show the general operating principle of the dedicated compartment for carrying a parallelepiped-shaped article, in particular a laptop computer or any equivalent device integrated into carrying means in accordance with the invention.

It should be stressed here that while the example described relates to a parallelepiped-shaped laptop computer, any other shape may be envisaged provided it includes at least one rectilinear surface designed to operate in conjunction with and be received by the panel (6) of the intermediate support component (5), in particular triangular or trapezoidal shapes.

Figure 2:
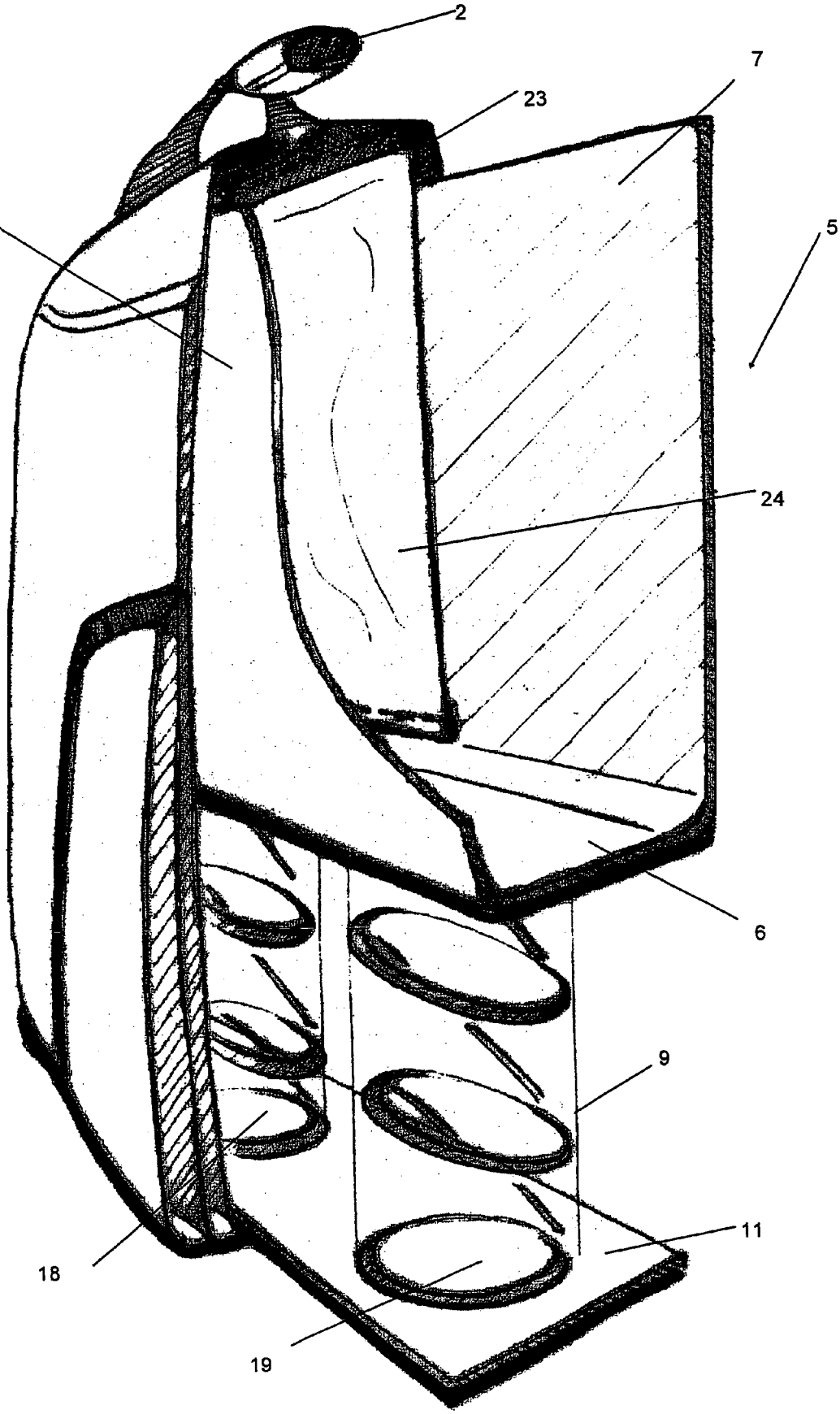
FIG. 2 is a cross-section view.

Furthermore, while the illustration of the operating principle of the invention in relation to FIGS. 3 and 4 only shows two springs, the number of springs may be increased according to the load to be supported, i.e. the weight of the article to be contained in the compartment. It is for this reason that FIGS. 1 and 2 show four springs.

Moreover, the spring constant of the different springs is also determined according to the weight of the article, in this case the laptop computer (20) to be carried, in addition to the desired ejection effect. This effect is particularly advantageous for enabling the user to grasp the laptop computer in order to remove it from the compartment into which it has been introduced.

As can be seen in FIG. 3, these springs may be compressed firstly by the weight of the article to be carried (20), and secondly by the pressure exerted by the user to introduce the entire article (20) inside the compartment and therefore to allow closure of the upper section or aperture (16) of the compartment.

To this end the article (20) to be carried may itself be provided with a tab (21) or any other suitable body designed to operate in conjunction or snap into a complementary-shaped locking device (22) fitted for this purpose to the upper end of compartment (10). In this way the laptop computer is never simply left loose in the compartment holding it but, but is always clamped between the intermediate support component (5) and the closing zone or means of the compartment.

This characteristic also gives greater adaptability in terms of the measurements of the article to be carried, in this case the shape of a laptop computer.

According to one alternative embodiment of the invention the compartment itself (10), or the carrying means, bag or briefcase, comprises means such as a strap fitted with a component designed to clamp the article inside the compartment, or additionally to close the aperture (16) of the compartment.

In another alternative embodiment of the invention it can even be envisaged that the laptop computer is placed inside a rigid protective shell that is itself inserted inside the compartment in question. In this situation one surface of the shell is then fitted with the means (21) that co-operates with the complementary means (22).

In another alternative embodiment of the invention the compartment presents, in the region of its upper end, an extension of one of its lateral surfaces that acts as a stopping zone for the laptop computer. Put another way, in order to wedge the computer inside this zone the computer must first be pressed against the support component (5) to make it drop inside the compartment. Then the springs cause it to be wedged inside the aforementioned zone provided for this purpose.

Advantageously, the panel (6) of support component (5) is extended by two lateral surfaces (7, 8) (see FIGS. 1 and 2) so as to constitute an internal receptacle.

Furthermore, and according to an improved version of the invention, these surfaces (7, 8) slide inside a housing (23) demarcated by a flap (24) provided inside each lateral surface of compartment (10).

There is thus created a genuine passageway that encourages insertion of the article to be carried inside the compartment.

Thus the article (20) to be carried, in particular a laptop computer, is maintained inside compartment (10) where it is protected against the impacts it is likely to sustain, particularly due to dropping of the carrying means or bag while it is being carried, or simply due to the carrying means being placed on the ground. The article is thus completely isolated from the ground, this result being particularly appreciable when the ground is wet.

Due to their physical properties, springs (18, 19), also perform a shock-absorbing function, giving the support assembly a compressible character and encouraging the effective protection conferred by the carrying means.

Furthermore the springs (18, 19) reduce the apparent weight of the article carried by limiting or even eliminating the inherent movement in the article in question.

It is not unusual in briefcases or bags of large measurements or capacity for the movements caused by the user walking or running to cause articles contained in the bag to make more or less large movements in their turn in a way that is slightly out of phase with the user's movements. This relative movement is unpleasant for the user, particularly due to the movement being out of phase and this character itself inducing movement that is itself out of phase with the rhythm of the user's steps. Using this type of hanging intermediate support component reduces the amplitude of this relative movement, thereby optimizing user comfort.

In addition, using this hanging support component means that the article carried is never in direct contact with the ground when the bag, briefcase or attaché case is put down. There is always a minimum height determined by the maximum compression of the springs that isolates the article from the ground.

This characteristic may present a certain number of advantages when the ground is wet, particularly as concerns damage to the article or through the laptop computer's peripheral connectors being brought into contact with moisture.

Lastly, these springs act to eject the article when the locking means are released, causing partial emergence of the article from the compartment and thereby enabling the user to grasp it.

Figure 5:
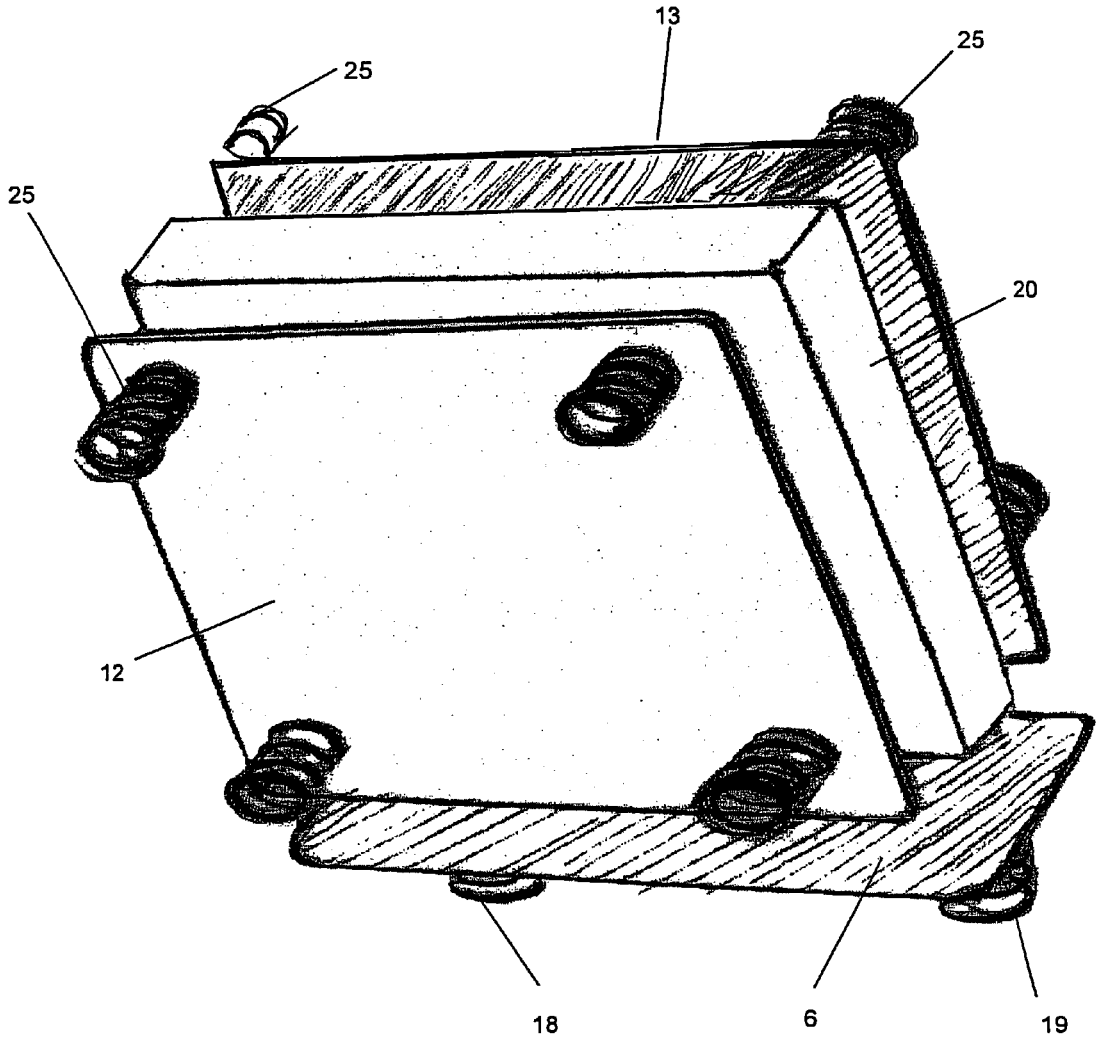
FIG. 5 is a schematic perspective illustration of a detail of an improved version of the invention.

In a further improved version of the invention that is shown in FIG. 5, at least some of the lateral surfaces demarcating the compartment in question may also be fitted with spring-type shock absorbers.

In this configuration the lateral surfaces, in this instance surfaces (12, 13), are movable and associated with coil springs (25) that cause a natural propensity, in the absence of external forces resulting from the introduction of the article to be carried inside the compartment, to move towards the center of the compartment.

By doing so, the wedging of the article to be carried inside the carrying means is encouraged, and most importantly there is optimal protection of the article against external impacts due to the sheer number of shock absorber means.

The advantages of the carrying means of the invention will now be understood. Apart from optimizing comfort in carrying, it particularly encourages the effective protection of an article, particularly a laptop computer, while not limiting the means solely to carrying this type of article.

The invention claimed is:

1. A carrying case for an article having at least one rectilinear surface, said carrying case comprising:

a base, two lateral end walls and two lateral side walls that are dimensioned and connected to define an internal compartment having a size large enough to accommodate the article;

an intermediate support component positioned within the internal compartment and having a bottom panel and two opposed side walls extending upwardly from said bottom panel;

at least one shock absorber connecting said bottom panel of said intermediate support component to said base so as to suspend said intermediate support component within said internal compartment; and a pocket member connected to each of said lateral side walls of said case, said pocket member having an inner surface that opposes an inner surface of one of said lateral side walls and opening downwardly into said internal compartment so as to receive a corresponding one of said two side walls of said intermediate support component in a sliding fashion.

2. A carrying case of claim 1, wherein the at least one shock absorber comprises a mechanical spring having a spring constant that is selected based on the weight of the article and the degree of shock-absorbing function that is required of the intermediate support component.

3. A carrying case of claim 1, wherein the mechanical spring is a coil spring that is bonded, sewn or riveted to the intermediate support component.

4. The carrying case of claim 1, further comprising a base panel fixed to the at least one shock absorber so that the intermediate support component, the at least one shock absorber and the base panel form an integrated unit that can be installed in the carrying case.

5. A carrying case of claim 1, further comprising a closure mechanism for closing an upper opening of the carrying case so that the article is accommodated within the internal compartment in an upwardly biased manner by a spring action of the at least one shock absorber, such that when the closure mechanism is released, the article is forced upwardly through the upper opening in the carrying case to allow the user to grasp the article outside the carrying case.

6. The carrying case of claim 1, further comprising complementary locking mechanisms on the article and on an upper portion of at least one of said lateral side walls of said case, which cooperate to maintain the article within the internal compartment in a locked fashion, but also allow the article to be released at which time the at least one shock absorber forces the article upwardly through an upper opening in the carrying case to allow the user to grasp the article outside the carrying case.

7. The carrying case of claim 6, wherein the intermediate support component defines a rigid protective shell in which the article is inserted, and one of the locking mechanisms is fixed to the rigid protective shell.

8. The carrying case of claim 1, wherein one of said lateral side walls of said carrying case includes an extension that acts as a stopping mechanism for the article once the article is placed in the internal compartment to such an extent that the at least one shock absorber is compressed.

9. The carrying case of claim 1, further comprising additional shock absorbers positioned between an inside surface of the lateral side walls of the carrying case and outside surfaces of the side walls of the intermediate support component.

* * * * *